US006271797B2

(12) United States Patent
Miller

(10) Patent No.: US 6,271,797 B2
(45) **Date of Patent: *Aug. 7, 2001**

(54) COMBINATION ANTENNA MOUNT

(75) Inventor: Paul E. Miller, Spring Lake, MI (US)

(73) Assignee: R. A. Miller Industries, Inc., Grand Haven, MI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/335,598

(22) Filed: Jun. 18, 1999

(51) Int. Cl.[7] ..... H01Q 1/32
(52) U.S. Cl. ..... 343/713; 343/725; 343/878
(58) Field of Search ..... 343/713, 878, 343/879, 880, 882, 725

(56) References Cited

U.S. PATENT DOCUMENTS

| | | | | |
|---|---|---|---|---|
| 5,456,442 | * | 10/1995 | Sutton et al. | 248/534 |
| 5,489,912 | | 2/1996 | Holloway . | |
| 5,610,620 | | 3/1997 | Stites et al. . | |
| 5,650,792 | | 7/1997 | Moore et al. . | |
| 5,706,015 | | 1/1998 | Chen et al. | 343/713 |
| 5,757,327 | | 5/1998 | Yajima et al. | 343/713 |
| 5,900,840 | * | 5/1999 | Yajima | 343/713 |
| 6,023,245 | * | 2/2000 | Gomez et al. | 343/713 |
| 6,031,499 | * | 2/2000 | Dichter | 343/713 |

FOREIGN PATENT DOCUMENTS

| | | | |
|---|---|---|---|
| 295 00 961 U | 5/1998 | (DE) | H01Q/1/32 |
| 0 862 239 A1 | 9/1998 | (EP) | H01Q/5/00 |
| 0 881 701 A1 | 12/1998 | (EP) | H01Q/1/32 |
| 2318217 | 4/1998 | (GB) . | |

OTHER PUBLICATIONS

International Search Report, PCT/US 00/10417, Dated Aug. 2000.

* cited by examiner

*Primary Examiner*—Tho Phan
*Assistant Examiner*—Hoang Nguyen
(74) *Attorney, Agent, or Firm*—Rader, Fishman, Grauer & McGarry

(57) ABSTRACT

An antenna mount for supporting a whip antenna on a ground vehicle has an upper part and a lower part, the upper part supports the whip antenna and has an upper mounting ring and the lower part extends through an outer shell of the vehicle has a lower mounting ring, one or more intermediate rings are disposed between the upper ring and the lower ring and incorporate a cavity for containing a GPS antenna.

25 Claims, 3 Drawing Sheets

COMBINATION ANTENNA MOUNT

BACKGROUND OF THE INVENTION

1. Field of the Invention

The present invention relates to antennas and more particularly to an antenna mount incorporating an antenna for use in the Global Positioning System (GPS).

2. Background of Related Art

GPS has become of critical importance in navigation of aircraft and many land vehicles, such as military vehicles. A GPS antenna is preferably mounted externally to a vehicle and is typically mounted in a separate housing. For certain applications, particularly for military ground vehicles, the antenna mount must be a rugged mount which can withstand substantial forces on the antenna, such as occurs in contact with trees or other structures. Many military tracked vehicles are armor plated and typically are provided with only two standard openings in the structure for antenna placement. With the proliferation of communication and navigational equipment in military vehicles, this limited number of openings is inadequate. Furthermore, armor plated vehicles cannot be readily modified to accommodate additional antenna mounts.

Known antenna mounts for military vehicles and the like, typically include a housing having an upper portion extending external to an outer wall of the vehicle and mounting a flexible antenna, while a lower portion of the housing extends through the vehicle wall for connecting the antenna to radio apparatus. Combination mounts for a GPS antenna in combination with a standard radio frequency (RF) antenna are known from the prior art. However, such mounts have to be especially designed and replace existing antenna mounts. Such replacement is costly, time consuming and typically changes the profile of the antenna mount to a significant extent. Furthermore, known combination antenna mounts are not designed to be rugged mounts that can withstand the forces on the antenna structure that is required for armored military vehicles.

It is desirable, therefor, to provide a rugged antenna housing for a GPS antenna. However, it is also desirable to provide a rugged GPS antenna structure without making further openings the exterior walls of the vehicle.

SUMMARY OF THE INVENTION

In accordance with the present invention, a standard rugged antenna mount for supporting an RF antenna, having an upper part extending external to an outer wall of a vehicle and a lower part extending through an existing antenna mount opening in the wall, is modified by the addition of at least one ring disposed exterior to the wall of the vehicle and incorporating a GPS antenna. In accordance with one specific aspect of the invention, the ring comprises a spacial area specifically adapted to mount the GPS antenna. In accordance with another aspect of the invention, the ring comprises the first and second rings, disposed adjacent one another, and each having an extended area and a cavity in the extended area for housing the GPS antenna.

Advantageously, in accordance with the present invention, the ring disposed between the upper part of the RF antenna housing and the lower part of the RF antenna housing contains a GPS antenna which may be connected to GPS read-out equipment through an opening in the lower part of the antenna housing disposed internal to the vehicle. Furthermore, the ring containing the GPS antenna may be added to a standard rugged antenna mount by simply adding the ring mounting the GPS antenna, without any significant change to the standard rugged antenna mount. The ring may be attached to a standard rugged antenna mount by means of screws extending through a rim portion of the antenna mount.

DETAILED DESCRIPTION

Figure 1:
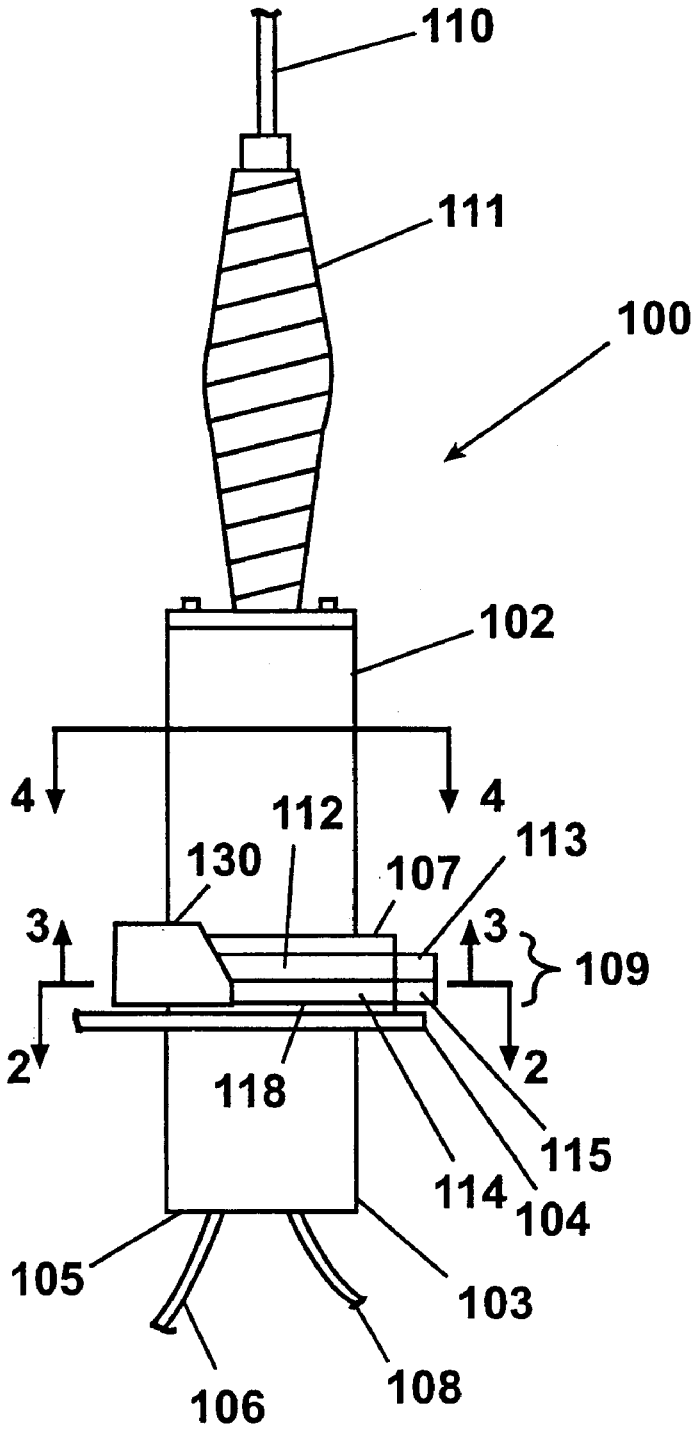
FIG. 1 is a schematic representation of an antenna mount incorporating the principles of the invention.

Shown in FIG. 1 is an antenna mounting base 100 extending through an outer wall 104 of a vehicle. The antenna mounting base 100 supports an RF antenna 110 on a coiled spring support 111, such as is commonly used on military ground vehicles, and incorporates a global positioning system (GPS) antenna internal to the mounting base 100. Further shown in FIG. 1 is an RF connecting cable 106 and a GPS connecting cable 108, both extending through a lower wall 105 of the antenna mounting base 100 to the interior to the vehicle. The cable 106 connects RF signals from the antenna 110 to RF equipment (not shown in the drawing) interior to the vehicle and the cable 108 connects signals from the GPS antenna to GPS read-out equipment (not shown in the drawing) interior to the vehicle. The mounting base 100 has an upper part 102 disposed exterior to the wall 104 and a lower part 103 disposed interior to the wall 104. The mounting base 100 includes a multiple ring structure 109 consisting of an upper mounting ring 107, an upper GPS ring 112, an upper GPS ring extension 113, a lower GPS ring 114, a lower GPS ring extension 115, and a lower mounting ring 118. The upper GPS ring 112 and the lower GPS ring 114 are removable rings. The upper mounting ring 107 and the lower mounting ring 118 are each formed as part of the antenna base 100 to provide a mounting ring whereby the base 100 is attached to a vehicle. As will be described further later herein, the upper and lower GPS rings 112, 114 together with ring extensions 113, 115 house the GPS antenna. The rings 107, 112, 114 and 118 are mounted to the outer wall of the vehicle 104 by means of screws (not shown in FIG. 1) extending through the rings 107, 112, 114 and 118. A mounting ring cover 130 is shown in a break-away view. The cover extends around the rings 107, 112, 114 and 118 and terminates at opposite ends of the ring extensions 113, 115.

Figure 2:
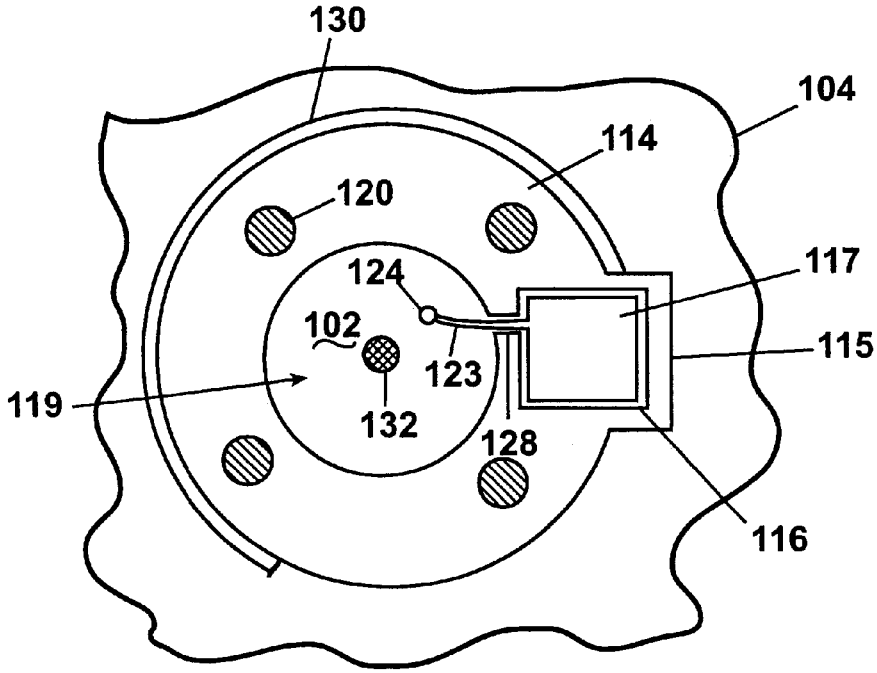
FIG. 2 is a cross-sectional view along line 2—2 of FIG. 1.

FIG. 2 is a cross-sectional view along line 2—2 of FIG. 1 and provides a top view of the lower GPS ring 114 together with the lower GPS ring extension 115. Mounting screws 120, shown in cross-section in FIG. 2, extend through upper mounting ring 107, the upper GPS ring 112, the lower GPS ring 114 and lower mounting ring 118 in to the outer wall 104 to fasten the antenna base 100 to the vehicle. Further shown in FIG. 2, in cross section is an antenna wire 122 extending in central cavity 119 of the antenna base 100. The antenna wire 122 connects the RF antenna 110 to the RF cable 106 shown in FIG. 1.

The lower GPS ring extension 115 is provided with a cavity 116 for retaining a GPS antenna and with a channel opening 128 extending from the cavity 116 to the central cavity 119. FIG. 2 shows a GPS antenna 117 disposed in the cavity 116 and connected via a lead wire 123, extending through the channel opening 128, to a GPS wire connector 124. The GPS wire connector 124 is connected to GPS read-out equipment internal to the vehicle via the GPS connecting cable 108 shown in FIG. 1.

Figure 3:
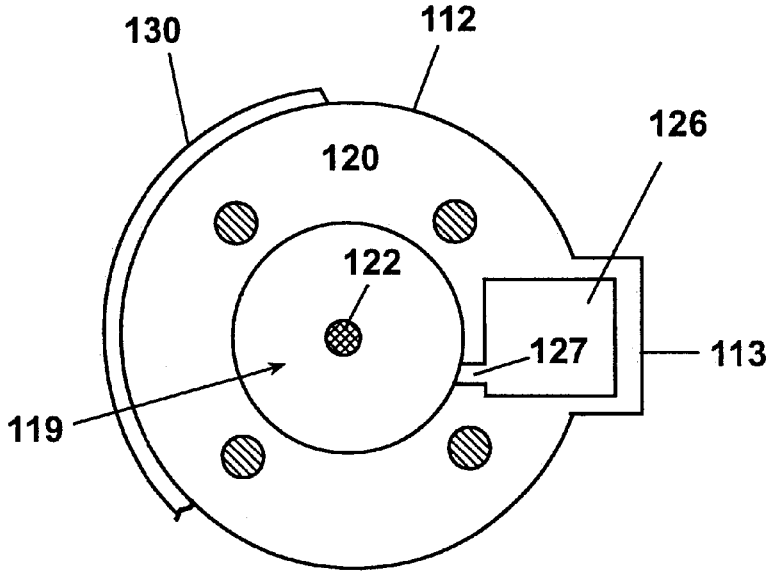
FIG. 3. is a cross-sectional view along line 3—3 of FIG. 1.

FIG. 3 is a cross-sectional view along the line 3—3 of FIG. 1 and provides a bottom view of the upper GPS ring 112. FIG. 3 shows the screws 120 and the RF antenna wire 122, in cross-section. Further shown in FIG. 3 is the upper GPS ring extension 113 provided with a cavity 126 and a channel opening 127 extending from the cavity 126 to the central cavity 119. When the upper GPS ring 112 and the lower ring 114 are disposed adjacent each other, as depicted in FIG. 1, the cavity 116 of the upper GPS ring 112 and the and the cavity 126 of the lower GPS ring 114 are aligned to form a spacial area for containing the GPS antenna 117. The channel opening 127 extending from the cavity 126 to the central cavity 119 and the channel opening 128 extending from the cavity 116 to the central opening, together provide a channel for the lead wire 123 extending from the GPS antenna 117 to the GPS lead wire connector 124 shown in FIG. 2.

Figure 4:
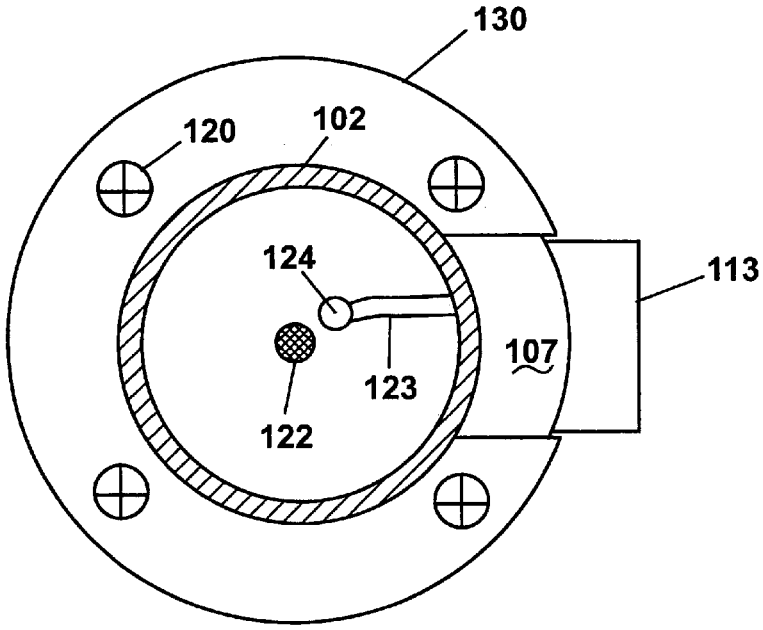
FIG. 4 is a cross-sectional view of the antenna mount of FIG. 1 along line 4—4.
Figure 5:
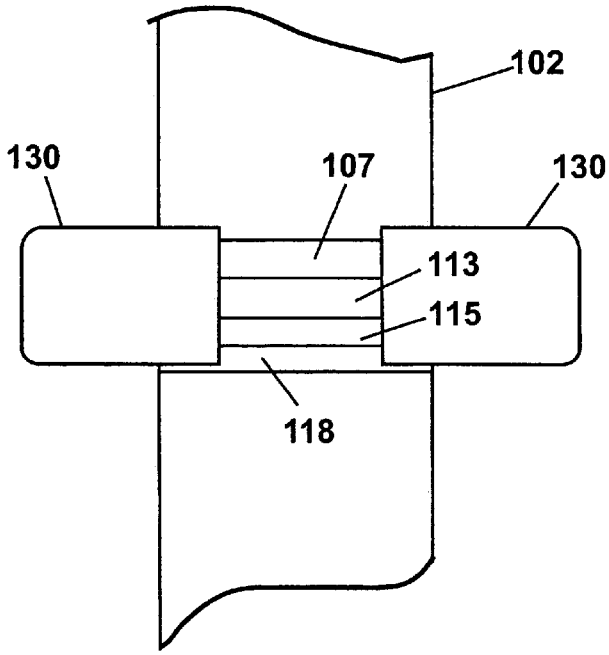
FIG. 5 is a breakaway right hand elevational side view of the antenna mount of FIG. 1.

FIG. 4 is a cross-sectional view along line 4—4 of FIG. 1 and shows an upper side of the cover 130 as well as the upper GPS ring extension 113. The outer wall of the upper part 102 of the mounting base 100 is shown in cross-section. Further shown in FIG. 4 are screws 120 and the antenna wire 122, shown in cross-section. Also depicted in FIG. 4 is the GPS wire connection 124 and the lead wire 123 connecting the GPS antenna 117 (not shown in FIG. 4) to the GPS connecting cable 108, shown in FIG. 1. FIG. 5 is a partial, breakaway right-hand elevational side view of the antenna mount of FIG. 1 including the GPS ring extensions 113, 115 of the upper GPS ring 112 and lower GPS ring 114, respectively, as well as a portion of the upper and lower mounting rings 107, 118. As depicted in FIG. 5, the cover 130 extends from one side of the upper and lower GPS ring extensions 113, 115 circumferentially around the upper mounting ring 107, the upper and lower GPS rings 112, 114 and the lower mounting ring 108 to the opposite side of the upper and lower GPS ring extensions 113, 115.

It is to be understood that the above-described arrangement is merely illustrative of the application of the principles of the invention and that other arrangements may be devised by those skilled in the art without departing from the scope of the invention as defined by the appended claims.

What is claimed is:

1. An antenna mount for mounting an antenna on an outer wall of a vehicle, the antenna mount comprising:

an upper end for supporting a radio frequency antenna and a lower end; and a mounting ring disposed intermediate the upper end and the lower end for mounting the antenna mount on the outer wall of the vehicle, the mounting ring comprising a cavity for supporting a GPS antenna in said mounting ring and wherein the mounting ring comprises an upper ring and a lower ring disposed immediately adjacent the upper ring and said cavity is formed in part in said upper ring and in part in said lower ring.

2. An antenna mount for mounting an antenna on an outer wall of the vehicle, the antenna mount comprising an upper end for supporting a radio frequency antenna and a lower end; and a mounting ring disposed intermediate the upper end and the lower end for mounting the antenna mount on the outer wall of the vehicle, the mounting ring comprising a cavity for supporting a GPS antenna in said mounting ring and further comprising a inner spatial area and channel opening extending from said cavity to said inner spatial area for accommodating a GPS antenna lead wire extending from said GPS antenna to said inner spatial area.

3. The antenna in accordance with claim 2 wherein the mounting ring comprises an upper ring and a lower ring disposed immediately adjacent the upper ring and said channel opening is formed in part in said upper ring and in part in said lower ring.

4. An antenna mount for use on a vehicle having an outer wall, said antenna mount adapted to be mounted on said outer wall and comprising:

an upper end for supporting a radio frequency antenna and a lower end; and a mounting ring disposed intermediate the upper end and the lower end for mounting the antenna on said outer wall of the vehicle and comprising an upper ring and a lower ring;

said upper ring comprising an upper ring extension extending outwardly from said upper ring in a specified direction and a cavity in said upper ring extension;

said lower ring disposed immediately adjacent said upper ring and comprising a lower ring extension extending outwardly from said lower ring in said specified direction and a cavity in said lower ring extension;

said cavity in said lower extension being disposed in substantial alignment with said cavity in said upper ring extension;

said cavity in said upper ring extension having an opening directed toward said cavity in said lower ring and said cavity in said lower ring having an opening directed toward said cavity in said upper ring; and wherein said cavity in said upper ring and said cavity in said lower ring together form a cavity for supporting a GPS antenna.

5. The antenna mount in accordance with claim 4 and further comprising an inner spatial area for accommodating antenna lead wires and a channel extending from said cavity to said inner spatial area.

6. The antenna in accordance with claim 5 wherein said channel is formed in part in said upper ring and in part in said lower ring.

7. An antenna mount adapted to be mounted on an outer wall of a vehicle and comprising:

an upper part for mounting an antenna externally to the outer wall of the vehicle and a lower part disposed below said upper part, said antenna mount further comprising a mounting ring for mounting said antenna on said outer wall and a cavity in said mounting ring for retaining a GPS antenna and a channel opening extending from said cavity to a GPS antenna cable for connection to a GPS receiver.

8. The antenna mount in accordance with claim 7 wherein said mounting ring comprises an upper mounting ring and a lower mounting ring and said cavity is formed in part in said upper mounting ring and in part in said lower mounting ring.

9. An antenna mount for use on a vehicle having a mounting surface, said antenna mount comprising an upper end for supporting a radio frequency antenna and a mounting flange on said upper end;

said antenna mount further comprising a lower end having a mounting flange disposed in alignment with said mounting flange of said upper end for mounting said lower end to a mounting surface;

said antenna mount further comprising an upper GPS ring and an upper GPS ring extension extending outwardly from said upper GPS ring in a specified direction and a lower GPS ring disposed adjacent the upper GPS ring and comprising a lower GPS ring extension extending outwardly from said lower GPS ring in said specified direction;

said upper and lower GPS ring extensions defining a cavity and a mounting ring cover extending at least in part over said upper and lower mounting flanges and said upper and lower GPS rings.

10. An antenna mount for mounting an antenna on an outer wall of a vehicle, the antenna mount comprising:

an upper end for supporting a radio frequency antenna and a lower end; and a mounting ring disposed intermediate the upper end and the lower end for mounting the antenna mount on the outer wall of the vehicle, the mounting ring comprising a cavity for supporting a GPS antenna in said mounting ring wherein the mounting ring comprises an upper ring and a lower ring disposed immediately adjacent the upper ring and the cavity is formed in one of the upper and lower rings.

11. An antenna for mounting to an outer wall of a vehicle comprising:

an antenna mount having an upper part, a lower part, and a mounting ring intermediate the upper part and the lower part for mounting the antenna mount to the outer wall, the mounting ring having a cavity dimensioned and positioned to be generally parallel to a radial plane of the mounting ring wherein the mounting ring comprises an upper ring and a lower ring disposed immediately adjacent the upper ring and the cavity is formed in one of the upper and lower rings, a whip antenna capable of receiving radio frequency waves mounted to the upper part and extending therefrom; and a GPS antenna mounted in said cavity generally orthogonal to the whip antenna.

12. The antenna in accordance with claim 11 and further comprising an inner spatial area and a channel opening extending from said cavity to said inner spatial area for accommodating a GPS antenna lead wire extending from said GPS antenna to said inner spatial area.

13. The antenna in accordance with claim 12 wherein the mounting ring comprises an upper ring and a lower ring disposed immediately adjacent the upper ring and said channel opening is formed in part in said upper ring and in part in said lower ring.

14. An antenna for mounting to an outer wall of a vehicle comprising:

an antenna mount having an upper part, a lower part, and a mounting ring intermediate the upper part and the lower part for mounting the antenna mount to the outer wall, the mounting ring having a cavity dimensioned and positioned to be generally parallel to a radial plane of the mounting ring wherein the mounting ring comprises an upper ring and a lower ring disposed immediately adjacent the upper ring and said cavity is formed in part in said upper ring and in part in said lower ring, a whip antenna capable of receiving radio frequency waves mounted to the upper part and extending therefrom; and a GPS antenna mounted in said cavity generally orthogonal to the whip antenna.

15. The antenna in accordance with claim 14 and further comprising an inner spatial area and a channel opening extending from said cavity to said inner spatial area for accommodating a GPS antenna lead wire extending from said GPS antenna to said inner spatial area.

16. The antenna in accordance with claim 15 wherein the mounting ring comprises an upper ring and a lower ring disposed immediately adjacent the upper ring and said channel opening is formed in part in said upper ring and in part in said lower ring.

17. An antenna mount for mounting an RF antenna and a GPS patch antenna to a surface having an aperture, the antenna mount comprising:

an upper portion for supporting an RF antenna and a lower portion, the lower portion having a dimension to be received in an aperture in a surface, the upper and lower portions defining an inner spatial area to accommodate an antenna lead; and a dielectric ring disposed intermediate the upper portion and the lower portion, said dielectric ring defining a central aperture in registry with the inner spatial area, the dielectric ring further having a cavity, offset from the inner spatial area, dimensioned to receive and support a GPS patch antenna.

18. An antenna mount according to claim 17 wherein the dielectric ring comprises two adjacent rings and both rings together define the cavity.

19. An antenna mount according to claim 18 wherein the cavity is formed in part in each ring.

20. An antenna mount according to claim 18 wherein the cavity is formed in one of the rings.

21. An antenna mount according to claim 17 wherein the ring has a channel extending from the cavity to the inner spatial area to accommodate an antenna lead extending from a GPS antenna, when mounted in the cavity, to the inner spatial area.

22. An antenna mount according to claim 17 wherein the dielectric ring has an extension portion and the cavity is in the extension portion.

23. An antenna mount according to claim 17 wherein the upper portion has a mounting flange.

24. An antenna mount according to claim 23 wherein the dielectric ring has an extension portion and the cavity is in the extension portion.

25. An antenna mount according to claim 24 wherein the portion of the dielectric ring other than the extension portion is congruent with the mounting flange.

* * * * *